United States Patent [19]

Shumaker

[11] 4,216,993

[45] Aug. 12, 1980

[54] TABLE AND SEAT APPARATUS

[75] Inventor: Gordon W. Shumaker, St. Paul, Minn.

[73] Assignee: Space Tables, Inc., Minneapolis, Minn.

[21] Appl. No.: 955,027

[22] Filed: Oct. 26, 1978

[51] Int. Cl.[2] ..... A47C 7/62; A47B 13/00

[52] U.S. Cl. ..... 297/157; D6/45; 108/161

[58] Field of Search ..... 297/157, DIG. 2; 428/528, 537; D6/45, 42; 108/55.5, 161

[56] References Cited

U.S. PATENT DOCUMENTS

| | | | |
|---|---|---|---|
| D. 200,412 | 2/1965 | Carr | D6/177 |
| D. 242,306 | 11/1976 | Campbell et al. | D6/45 |
| 2,877,827 | 3/1959 | Anderson | 297/157 |
| 2,894,561 | 7/1959 | Mackintosh | 297/172 |
| 3,396,678 | 8/1968 | Jensen | 108/55.5 |
| 3,411,823 | 11/1968 | Bue | 297/157 X |
| 3,688,419 | 9/1972 | Woolman | 297/157 |
| 3,970,401 | 7/1976 | Lubeck | 297/DIG. 2 |
| 4,092,042 | 5/1978 | Cusenbary | 297/157 |

FOREIGN PATENT DOCUMENTS

| | | | |
|---|---|---|---|
| 845574 | 6/1970 | Canada | 108/161 |
| 2612403 | 6/1977 | Fed. Rep. of Germany | 108/161 |
| 2114869 | 11/1971 | France | 108/161 |
| 887206 | 1/1962 | United Kingdom | 297/157 |

*Primary Examiner*—James T. McCall

*Attorney, Agent, or Firm*—Clayton R. Johnson

[57] ABSTRACT

Table and seat apparatus that includes a table top having three longitudinally spaced wood support members, kraft fiber cross beams extending between each adjacent pair of support members, a vertical edge grained balsa wood panel above the cross beams and wood support members, fiberglass reinforced plastic encapsulating the panel, support members and cross beams, and a flexible polyester material finish on top of the above fiberglass, a seat at each side and end that includes a seat panel encapsulated in fiberglass, a metal framework at each end portion of the table top for supporting the table top and side seats in an elevated condition at either side of the table, and one end seat mounting member joined to the respective framework for supporting an end seat at each end of the table top.

8 Claims, 9 Drawing Figures

TABLE AND SEAT APPARATUS

BACKGROUND OF THE INVENTION

A table and seat combination connected together as a single unit.

In the prior art it is old to form a combination table and chair set as a single unit, for example see U.S. Pat. No. 2,570,301. Additionally, it is old to use a laminated resin-impregnated material such as paper as a veneer for tables, for example see U.S. Pat. No. 2,563,111. However, with prior art tables that are left out in all weather conditions, sun, rain and cold, table finish and warpage problems have been encountered. In order to overcome problems such as the above, this invention has been made.

SUMMARY OF THE INVENTION

Table and seat apparatus that includes a table top having a balsa wood panel, support members below the wood panel, a fiber reinforced plastic encapsulating the panel and support members; seats having wood seat panels encapsulated by a fiber reinforced plastic; and framework for mountingly supporting the table top and seats in an elevated position.

One of the objects of this invention is to provide a new and novel table top that can withstand all weather conditions without any substantial warpage. Another object of this invention is to provide a new and novel fiber reinforced plastic encapsulated wood panel for use in the construction of a table. A further object of this invention is to provide a combination of a table and seats of a unique construction.

Figure 1:
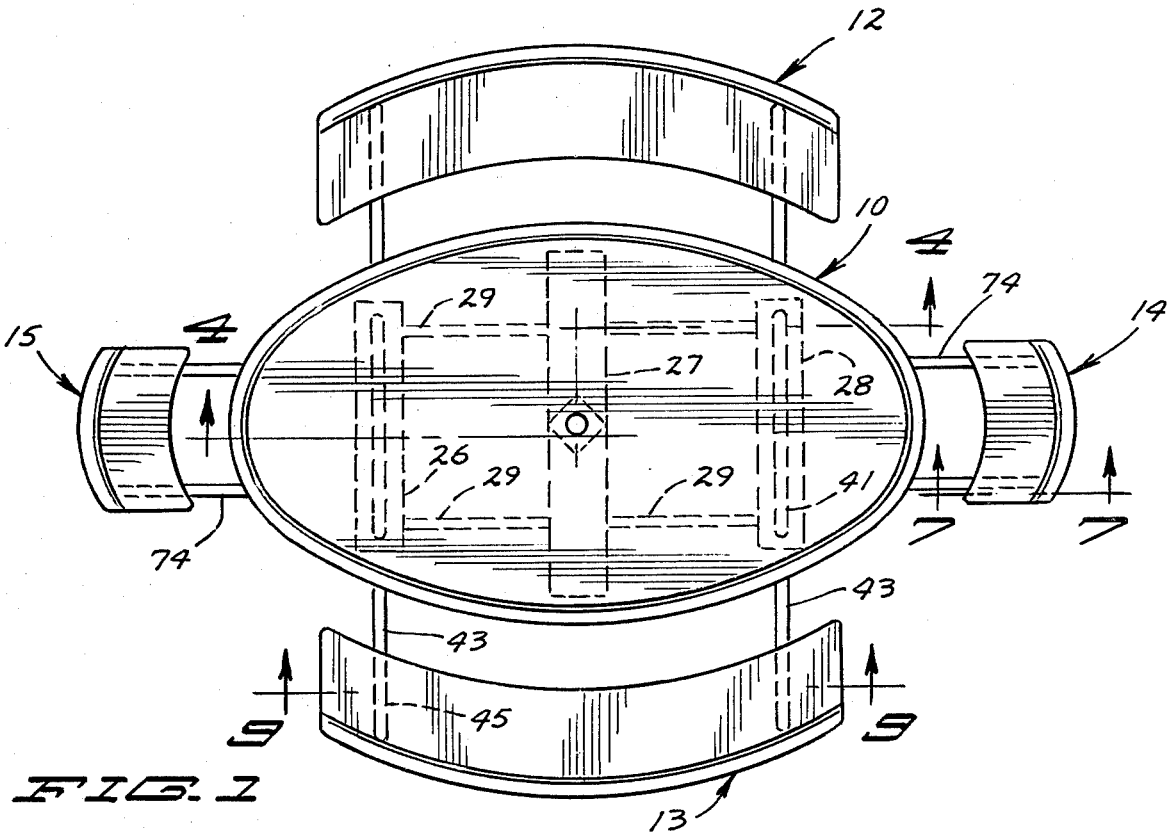
FIG. 1 is a plan view of the table seat apparatus of this invention.
Figure 2:
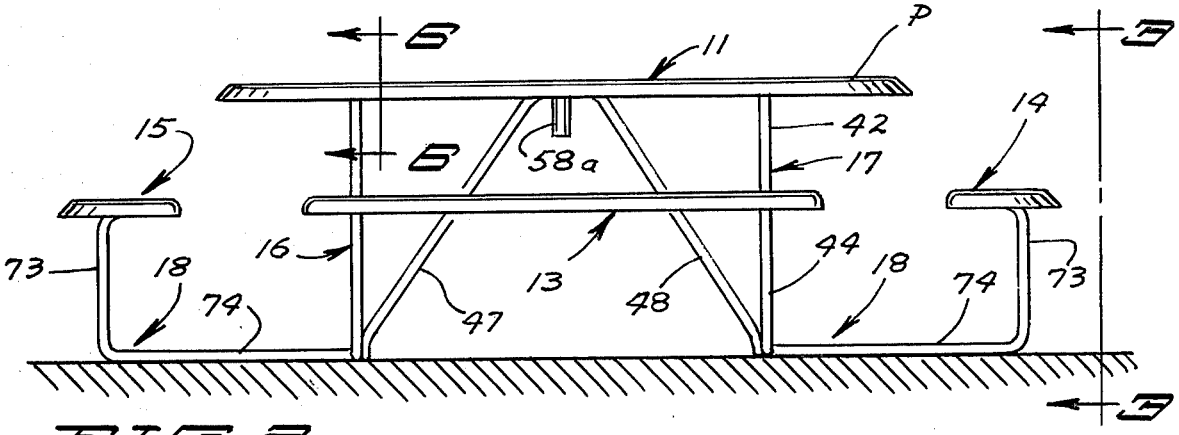
FIG. 2 is a side view generally taken along the line and in the direction of the arrows 2—2 of FIG. 3.
Figure 3:
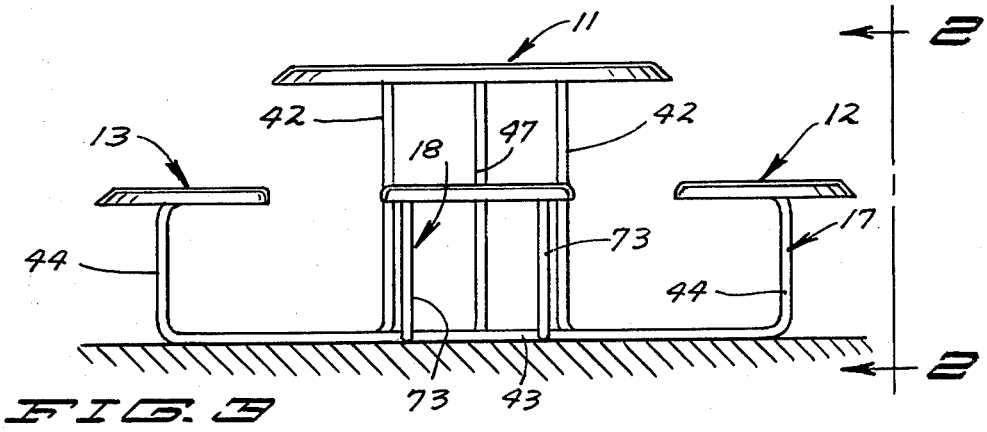
FIG. 3 is an end view generally taken along the line and in the direction of the arrows 3—3 of FIG. 2.

Unless otherwise indicated the term "inner" will refer to that part or portion of a structural member that is horizontally more closely adjacent to the center of the table top than a part of the same structural member that is referred to as "outer."

Referring now in particular to FIGS. 1–4, the table and seat apparatus, generally designated 10, of this invention includes a table top 11, a side seat 12, a second side seat 13, an end seat 14, a second end seat 15, a framework 16, a second framework 17 and a pair of end seat mounts 18, each of which are generall designated. The table top 11, which is of an elliptical shape in a plan view, includes a first plastic layer 22 having a portion **22*a*** that is nearly horizontal, i.e. the horizontal center point of the top surface is slightly higher than the edges to provide a crown of a hardly noticable curvature so that liquid will drain off the table top.

Joined to the outer peripheral edge **22*c* of the horizontal portion 22*a* to extend downwardly in a direction horizontally outwardly of the table top center is a frusto elliptical, perimetric flange 22*b*. Overlying the top layer is a thin finish layer 24** (the thickness of the finish layers relative to the plastic layers being exaggerated in the drawings).

Abutting against the undersurface of the horizontal layer portion **22*a* is a balsa wood panel 21 that is of the same shape as the horizontal portion 22*a* but of slightly smaller horizontal dimensions whereby the eliptical edge 21*a* of panel 21 is a short distance inwardly of the peripheral edge 22*c* of horizontal portion 22*a*. The balsa wood is edge grained with the grain of the wood being vertical. A suitable balsa wood is sold under the trademark "CONTOURKORE" and manufactured by Baltex Corp., Northvale, N.J. A second layer of plastic 25 is joined to layer 22 and surrounds the part of the panel 21 that is out of abutting relationship with layer 22 whereby panel 21 is encapsulated by layers 22, 25**.

Three transversely elongated rectangular support members 26, 27 and 28, respectively, in longitudinally spaced relationship abut against the bottom surface of layer 25. The transverse dimensions of the support members are a little less than the corresponding transverse dimensions of the layer 25. Extending between each adjacent pair of support members are a pair of transversely spaced, longitudinally elongated supports (cross beams) 29. Each of the supports 29 is of a length to have its opposite ends abut against the support members, or its opposite ends slightly spaced from but closely adjacent thereto. The supports advantageously are of a shape to be arcuate segments of a cylindrical tube, extend through an arc that is substantially less than 120°, and have the transversely center lines of their radially outer surfaces abut against the undersurface of layer 25. A layer of plastic 30 is joined to layer 25 and surrounds the parts of support members 26, 27, 28 and supports 29 that are out of abutting relationship with layer 25 whereby layers 25, 30 encapsulate support members 26, 27, 28 and supports 29. The portions of layer 30 that in conjunction with layer 25 encapsulate the support members, other than when supports 29 abut thereagainst, have been shown as portions **30*a*, 30*b*, 30*c* for support members 26, 27, 28, respectively, while the portions of layer 30 that extend between portions 30*a*, 30*b*, 30*c* have been designated by 30*d***.

To support the table top there are provided frameworks 16 and 17 at opposite end portions of the table. The frameworks are of the same construction, preferably made of tubular steel, and each includes a transversely elongated top frame member 41 of a somewhat shorter transverse dimension than support members 26, 28, a pair of parallel vertical table legs 42 that have their upper ends joined to opposite end portions of top member 41, a transversely elongated bottom frame member 43 having the lower ends of the table legs joined to the intermediate portion thereof, a pair of parallel vertical seat support legs 44 having their lower ends joined to the opposite ends of the bottom member and a generally horizontal side seat support member 45 joined to the upper end of each of legs 44 to extend inwardly toward the other seat support member 45. The spacing of legs 44 from the transverse center of the bottom member is the same as is the spacing of legs 42 from said center. Further, a single vertical plane passes through all the framework members and legs 41–45 of the same framework.

The top members 41 are joined to the respective one of support members 26, 28. Advantageously holes are bored through plastic layer 30 and into support members 26, 28, bolts or studs have their head ends positioned in the support member holes with their threaded ends extending away from the support members, and a resinous material is used to seal the head ends in the holes and to cover any adajcent exposed part of the support members. When the table is assembled, the threaded ends of the bolts are extended through bolt holes (not shown) in members 41 and nuts 46 threaded thereon. A diagonal brace 47 has one end bolted or otherwise joined to the transverse center part of the bottom member of framework 16, and an opposite end joined to the transverse center part of support member 27 which advantageously maybe by a bolt 50 mounted by support member 27 in the same manner described with reference to the bolts mounted by support members 26, 28. Likewise, a diagonal brace 48 has an end joined to the bottom member of framework 17 and support member 27.

Advantageously, the legs 44 and members 43, 45 of each framework may be made from a single tube that is bent to be of the shape described. Legs 42 advantageously may be welded to members 41, 43. Further the transverse dimension of the bottom member 43 is substantially greater than the maximum transverse dimension of the table top so that member 43 extends a substantial distance outwardly on either side thereof. Additionally the longitudinal spacing of each top member 41 from the center of the table top is greater than half the maximum longitudinal distance from the center of the table to the end of the table top that is adjacent to said member. As a result the table cannot accidentally be tipped.

Figures 4, 5, 6, 7, 8, 9:
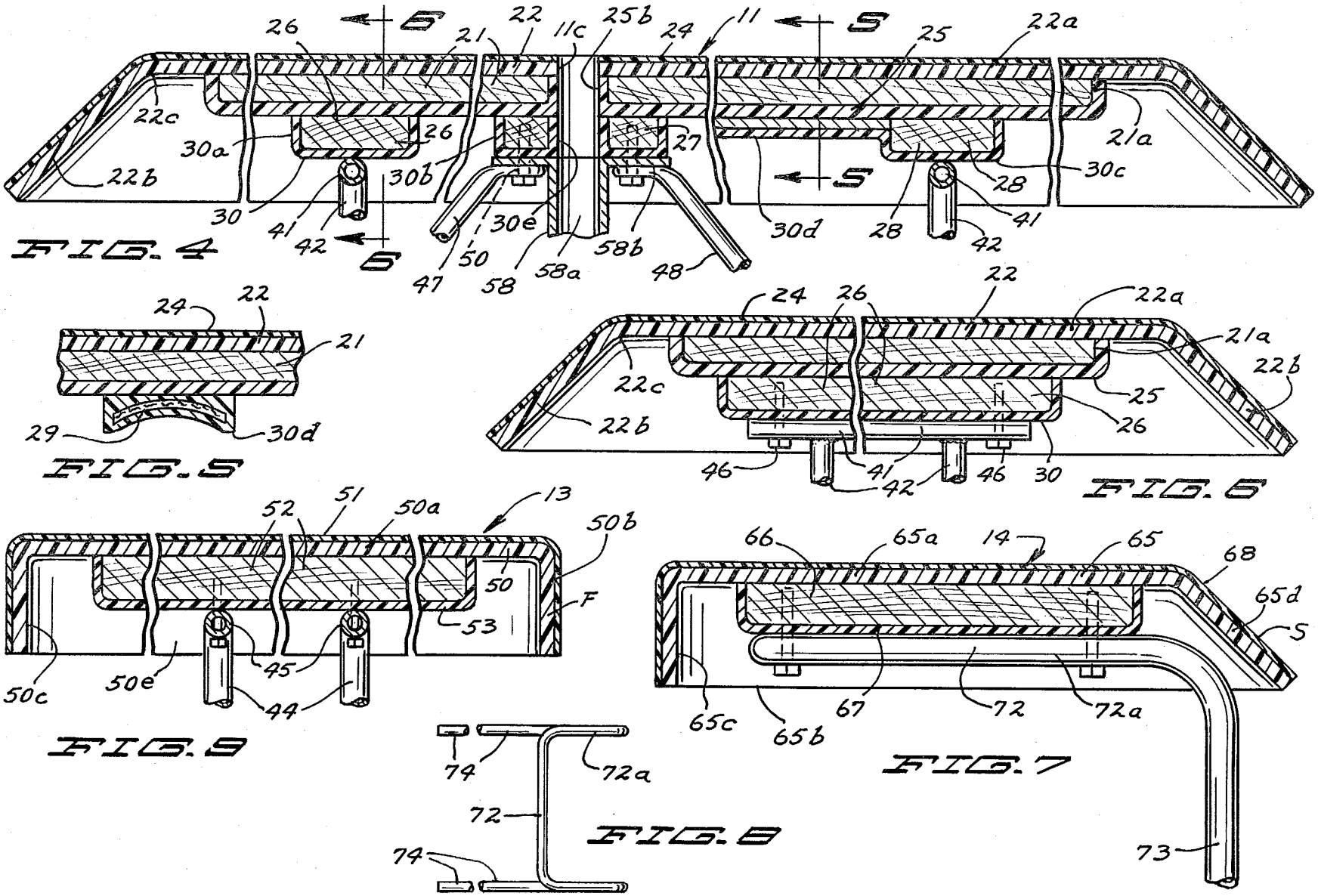
FIG. 4 is a longitudinally cross section view of the table top with various longitudinally intermediate portions broken away, said view being generally taken along the line and in the direction of the arrows 4—4 of FIG. 1.
FIG. 5 is a fragmentary transverse cross sectional view generally taken along the line and in the direction of arrows 5—5 of FIG. 4.
FIG. 6 is a transverse cross sectional view generally taken along the line and in the direction of the arrows 6—6 of FIG. 4 with an intermediate portion thereof being broken away.
FIG. 7 is a longitudinal cross sectional view of one of the end seats and a part of the end seat mount, said view being generally taken along the line and in the direction of the arrows 7—7 of FIG. 1.
FIG. 8 is a plan view of one of the end seat mounts with portions broken away.
FIG. 9 is a longitudinal cross sectional view of one of the side seats with longitudinally intermediate portions of the framework that mounts the seat, said view being generally taken along the line and in the direction of the arrows 9—9 of FIG. 1.

Each of the side seats 12 and 13 is of the same construction, including size and shape. Further, each of the seats 12 and 13 includes a top reinforced plastic layer 50 (see FIG. 9) having a horizontal top portion 50*a* and a perimetric flange integrally joined thereto to depend therefrom. This perimetric flange includes opposite vertical end flange portions 50*b*, 50*c*, a vertical inner side portion flange portion 50*e*, and an outer outwardly and downwardly inclined flange portion that in transverse cross section is inclined as shown in FIG. 7 for flange portion 65*d* for seat 14. Flange portions 50*b*, 50*c* are planar and parallel to one another; while flange portion 50*e* and the inclined flange portion are each elliptically curved so that in plan view the horizontal transverse spacing from the adjacent table top edge along the length of the respective last two mentioned portions is the same (see FIG. 1).

A finish layer 51 is provided on layer 50 to cover the top of portion 50*a* and the outer surface of the perimetric flange of layer 50. Abutting against the under surface of layer 50 is a wood seat panel 52 that in plan is of substantially the same shape as that of portion 50*a*, but is of somewhat smaller transverse and longitudinal dimensions so as to have its edges spaced from perimetric flange of layer 50. A plastic layer 53 is joined to layer portion 50*a* to in conjunction therewith encapsulate panel 52.

The seats 12, 13 are mounted on transversely opposite sides of the table on the respective pair of inturned framework portions 45. For example, the seats may be bolted to portions 45 in the same manner as described for bolting frame work portions 41 to the table top.

Each of the end seats 14 and 15 are of the same construction as seats 12 and 13, except for size and shape. The end seats are of longitudinal dimensions that are about the same as the transverse dimensions of the side seats, but of much smaller transverse dimensions than the longitudinal dimensions of the side seats. The end seats include a top reinforced plastic layer 65 having a horizontal portion 65*a*, and a perimetric flange that includes vertical side flanges 65*b*, a vertical inner end flange 65*c* and an outer downwardly and outwardly inclined flange 65*d*, a wood panel 66, a layer of plastic 67 that in conjunction with layer 65 encapsulates panel 66, and a finish layer 68.

Each end seat mount 18 (see FIGS. 2, 7 and 8) includes a generally U-shaped top horizontal portion 72 having the inner ends (terminal end of the U member) of legs 72*a* joined to the upper ends of the generally parallel vertical legs 73, the lower ends of legs 73 being joined to the outer ends of generally parallel horizontal members 74. Members 74 are of substantially longer than legs 72*a* and have their inner ends joined to the adjacent framework member 43. Each of the end seats is mounted on the U-shaped portion 72 of the respective mount, for example by being bolted to the legs 72*a* thereof in a manner described with reference to bolting the table top to member 41. The end seat mounts may each be made of a single steel tube to be of a shape such as described and illustrated.

If no umbrella support is provided, the table top including panel 21, is imperforated. However, the table may be provided with an umbrella support 58 that includes a depending tubular portion 58*a* that opens to a center bore 11*c* in the table top and a plate portion 58*b* abutting against the under surface of layer portion 30*b*. In such a case, the bolts for bolting the upper ends of braces 47, 48 are extended through bolt apertures in plate portion 58*b*. If a bore 11*c* is provided it can in part be defined by tubular portion 25*b* of layer 25 and in part by tubular portion 30*e* of layer 30.

A transverse cross sectional view of the side seats would be the same as that shown in FIG. 7 for the end seats while, a transverse cross sectional view of the end seats would be the same as that shown in FIG. 9 for the side seats. As may be noted from FIG. 1, the outer and inner edges of the end seats are elliptically to be of nearly the same curvature as the adjacent ends of the table top and are horizontally spaced therefrom.

Preferably the finish layer of the table top and each of the seats is made from a flexible polyester gelcoat material such as iso-phthallic-glycolester, ortho-phtallic-glycolester or neo-penlyl-glcolester. The gelcoat is applied directly in an appropriate mold form and coloring material, for example, colored metal flakes such as those sold under the trademark "POLYFLAKE JEWELS" mixed therein. After the gelcoat has stabilized or has completely cured, the top plastic layer (22, 50, or 65, respectively) is formed. Preferably the top plastic layer is made of a composite material of polyester resin and chopped fiberglass strands that may be applied on the finish layer by conventional hand lay-up techniques or mechanical procedures and is manually compacted by mechanical rollers.

After the top plastic layer is stabilized or cured, the wood panel (52,66 for seats or 41 for the table top) is applied on top of the top plastic layer. A second plastic layer (63,67 or 30) is applied over the wood panel, compacted and cured or allowed to stabilize. The second layer preferably is of the same material as the top plastic layer.

As to the table top, supports members 26, 27, 28 and support 29 are appropriately placed on top of the second layer and then they are covered with a third layer 30 of the fiberglass resin mixture compacted and the mixture allowed to cure. The supports 29 advantageously are made of kraft fiber while the support members and seat wood panels advantageously are plywood.

Preferably the table top wood panel 21 is a vertical edge grain balsa-wood. This type of wood panel is a light weight, resilient material, which has the unique property of low thermal expansion. The vertical edge grain balsa wood reinforcement encapsulated by the figerglass resin provides the advantages of: (1) the top becomes exceedingly resilient, and will resist impact shocks much more effectively than a fiberglass top without the balsa wood reinforcement, and (2) the use of the balsa wood, due to its resiliency and low coefficient of thermal expansion, allows the fiberglass of the table top to distort in a controlled fashion, either from heat or cold, or mechanical abuse, and yet the table top returns to its original shape and maintains its design integrity.

The kraft fiber support members 29 are used to maintain the physical shape of the table during mechanical abuse such as heavy loading.

The elliptically shaped table top of the construction, and the construction of the seats and mounting thereof, described herein provides a patio table that has easy access for seating, a smooth top surface, durable, and a decorative eye-appealing shape.

The end seats and end seat mounts are optional, i.e. the table seat apparatus may be made either with or without such end seats and end seat mounts. Further if desirable, the framework and end seat mounts may be covered with a heavy-duty, baked enamel.

The dimensions of U-shaped portions 72 in a transverse direction are less than the corresponding dimensions of the end seats while the dimensions of the members 45 in a transverse direction are less than the corresponding dimensions of the side seats. Further the height of the perimetric flange S of the end seats and the height of perimetric flange F of the side seats is sufficiently greater that these flanges extend to a lower elevation than and surround members 72 and 45, respectively. Further the perimetric flange P of the table top which is concentric to the remainder of the table top extends to a lower elevation than member 41.

What is claimed is:

1. A table seat combination comprising a table top having a first end portion, a second end portion and opposite sides, said table top including a wood panel having a top surface and a bottom surface, a first and a second support member and plastic material encapsulating the wood panel and support members, a first seat, a second seat, a third seat adjacent and spaced from the table first end portion, a fourth seat adjacent and spaced from the table second end portion, framework means for supporting the first and second seats in an elevated condition, said framework means comprising a first framework and a second framework spaced from the first framework, each of said frameworks including an elongated bottom horizontal frame member having a first end portion below and remote from one side of the table in a horizontal direction and a second end portion below and remote from the other side of the table in a horizontal direction, a horizontal first seat frame member above the bottom frame member and remote from one side of the one side of the table in a horizontal direction for supportingly mounting the first seat, a horizontal second seat frame member above the bottom frame member and remote from the other side of the table in a horizontal direction for supportingly mounting the second seat, first leg means joined to the bottom frame member first end portion for supporting the first seat frame member, second leg means joined to the bottom frame member second end portion for supporting the second seat frame member, a top frame member joined to the table top and vertically extending third leg means for mounting the top frame member on the bottom frame member, each support member being located between the wood panel and one of the top frame members, a first mount having a horizontal portion that has a first end joined to one of the bottom frame members and an opposite end portion that is remote from the table top first end portion in a horizontal direction and means joined to the first mount horizontal portion opposite end portion for mounting the third seat, and a second mount having a horizontal portion that has a first end joined to the other bottom frame member and an opposite end portion that is remote from the table top second end portion in a horizontal direction and means joined to the second mount horizontal portion opposite end for mounting the fourth seat.

2. A table seat combination comprising a longitudinally elongated table top having a first end portion, a second end portion and opposite first and second sides, said table top including a wood panel having a bottom surface, a plurality of longitudinally spaced, transversely elongated support members that are below and spaced from said wood panel bottom surface, a plastic material encapsulating the wood panel and support members, a longitudinally elongated first seat on one side of the table top, a longitudinal elongated second seat on the other side of the table top, each seat having a first end portion and a second end portion, first framework means for supporting the first end portions of the table top and seats in an elevated condition and second framework means for supporting the second end portion of the table top and seats in an elevated condition, each framework means being joined to at least one of the support members.

3. The apparatus of claim 1 further characterized in that each framework means includes a transversely elongated bottom frame member having a first end portion that is remote from the table top first side in a horizontal direction and a second end portion that is remote from the table top second side in a horizontal direction, means secured to the table top first end portion and joined to one of the bottom frame members for supporting the table top first end portion, means secured to the table top second end portion and joined to the other of the bottom frame members for supporting the table top second end portion, each of the means secured to the table top including a vertically extending leg joined to the respective bottom frame member to extend thereabove, means joined to the bottom frame members first end portions and secured to the first seat for supporting the first seat, and means joined to the bottom frame members second end portions and secured to the second seat for supporting the second seat.

4. The apparatus of claim 3 further characterized the means secured to the first seat includes a first leg having a lower end joined to one of the bottom frame members first end portion and a upper end portion attached to the first seat and a second leg having a lower end joined to the other bottom frame member second end portion and an upper end portion attached to the first seat.

5. The apparatus of claim 3 further characterized in that each of the means secured to the table top includes a top frame member that is attached to one of said supports and joined to the leg that forms part of the last mentioned means.

6. A table and seat combination comprising a longitudinally elongated table top having transverse opposite first and second sides, longitudinally opposite first and second end portions, a longitudinally elongated first seat on one side of the table top, a longitudinally elongated second seat on the other side of the table top, each seat having a first end portion and a second end portion, first framework means for mountingly supporting the first end portions of the seats and table top in an elevated condition, and second framework means for mountingly supporting the second end portions of the table top and seats in an elevated condition, each framework means including a transversely elongated bottom frame member having a first end portion that is remote from the table top first side in a horizontal direction and a second end portion that is remote from the table top second side in a horizontal direction, a vertically extending first leg having an upper end attached to respective table top end portion and a lower end joined to the bottom frame member, a second leg having an upper end and a lower end joined to the bottom frame member first end portion and a third leg having an upper end and a lower end joined to the frame member second end portion, the upper ends of the second legs being attached to the respective end portion of the first seat and the upper ends of the third legs being attached to the respective end portion of the second seat.

7. The apparatus of claim 1 further characterized in that the table top is elliptical and that each seat has an elliptically curved, elongated edge horizontally adjacent and spaced from the table top.

8. The apparatus of claim 6 further characterized in that for each framework the legs thereof and bottom frame member are located to have a common vertical plane passed therethrough.

* * * * *